US005417393A

United States Patent [19]

Klestadt

[11] Patent Number: 5,417,393

[45] Date of Patent: May 23, 1995

[54] ROTATIONALLY MOUNTED FLEXIBLE BAND WING

[75] Inventor: Ralph H. Klestadt, Sherman Oaks, Calif.

[73] Assignee: Hughes Aircraft Company, Los Angeles, Calif.

[21] Appl. No.: 52,985

[22] Filed: Apr. 27, 1993

[51] Int. Cl.[6] ..... F42B 10/16

[52] U.S. Cl. ..... 244/3.27; 244/3.21; 244/3.29; 244/45 R; 244/46

[58] Field of Search ..... 244/3.21, 3.23, 3.24–3.3, 244/34 A, 45 R, 45 A, 46, 900, 902

[56] References Cited

U.S. PATENT DOCUMENTS

| | | | |
|---|---|---|---|
| 1,448,166 | 3/1923 | Strong | 244/3.29 |
| 3,135,484 | 6/1964 | Herrmann | 244/34 A |
| 3,165,281 | 1/1965 | Gohlke | 244/49 |
| 3,188,957 | 6/1965 | Petre | 244/3.27 |
| 3,279,723 | 10/1966 | Wieland et al. | 244/900 |
| 3,374,969 | 3/1968 | Rhodes | 244/3.27 |
| 3,603,533 | 9/1971 | Stripling | 244/3.23 |
| 3,790,103 | 2/1974 | Peoples | 244/3.23 |
| 4,964,593 | 10/1990 | Kranz | 244/3.24 |
| 5,139,215 | 8/1992 | Peckham | 244/3.24 |

*Primary Examiner*—Harold J. Tudor
*Attorney, Agent, or Firm*—R. M. Heald; C. D. Brown; W. K. Denson-Low

[57] ABSTRACT

A vehicle such as a missile (20) includes an aerodynamically shaped missile body (22) having a longitudinal centerline, a set of control surfaces (26) joined to the missile body (22), and, preferably, a propulsion system (28) operable to drive the missile body (22) forwardly. A cylindrical rotational bearing (32) is mounted on the missile body (22) with its cylindrical axis parallel to the longitudinal centerline (24) of the missile body. A flexible band wing (38) is supported from the rotational bearing (32). The flexible band wing (38) may rotate about the centerline (24) of the missile body (22) responsive to aerodynamic forces exerted on the missile body (22) and the flexible band wing (38) to aid in making maneuvers without requiring the missile (20) to bank to align the flexible band wing (38) with the direction of the maneuver.

10 Claims, 2 Drawing Sheets

ROTATIONALLY MOUNTED FLEXIBLE BAND WING

BACKGROUND OF THE INVENTION

This invention relates to the flight control of winged vehicles, and, more particularly, to the control of missiles utilizing a flexible band wing.

Missiles typically have an aerodynamically shaped body, a propulsion system, and some approach for controlling the direction of movement of the missile. Control may be achieved in any of several ways, such as movable control surfaces mounted directly or indirectly to the body, gimballed engines, or thrusters. Some missiles rely solely upon the lift of the body and the thrust of the engines to achieve flight, while others have wings to provide lift.

One type of wing useful on missiles that must be stored in a limited space before launch is the flexible band wing. The wing includes a flexible band that is mounted to the body of the missile with hinged, collapsible struts. When the missile is carried aboard a launch vehicle such as an aircraft, the struts are collapsed against the body of the missile and the flexible band is wrapped around the body of the missile to conserve space. The flexible band is held in place with a retention mechanism, such as a releasable strap. Upon launch, the strap is released and the mechanical stresses incurred by wrapping the wing around the body cause the band to unwrap itself, so that it pulls it away from the body of the missile. The strut hinges open outwardly to extend the struts. The flexible band is thereby supported and constrained to lie on a generally semicircular arc around the body of the missile, generating upward lift as the missile flies. The lifting force is transmitted into the body of the missile through the struts. The flexible band wing can provide significant benefits to flight of the missile, such as extended range due to the increased lift provided by the flexible band wing, at little size penalty when stored.

To turn a missile having a flexible band wing, control surfaces at the nose or tall of the missile are operated responsive to a controller system. The flexible band wing itself has no control surfaces. The control surface movements generate aerodynamic forces which tend to push the nose or tail of the missile to the side. The result is that the tail or nose, respectively, of the missile is pushed in the desired direction to initiate the turn.

The presence of the flexible wing, however, may adversely affect the ability of the missile to turn responsive to the control forces. It is observed that in many flight orientations the missile with the flexible band wing turns more sluggishly than a comparable missile not having the flexible band wing. The presence of the flexible band wing, while contributing to missile fight characteristics such as range, may therefore have an adverse effect upon other characteristics such as maneuverability.

There is a need for an improved approach to achieving the benefits of the flexible band wing while retaining good maneuverability of the missile. The present invention fulfills this need, and further provides related advantages.

SUMMARY OF THE INVENTION

The present invention provides an improved missile or other aerodynamic flight vehicle utilizing a flexible band wing. The approach of the invention increases the maneuverability of the flight vehicle by automatically changing the orientation of the flexible band wing during maneuvering. The flight vehicle of the invention has the same size as the the conventional flight vehicle, but a slightly increased weight due to structural modifications.

In accordance with the invention, a vehicle comprises an aerodynamically shaped body having a longitudinal centerline, means for controlling the direction of motion of the body, and a propulsion system operable to drive the body forwardly. There is a flexible band wing supported from the body and means for permitting the flexible band wing to rotate about the centerline of the body responsive to aerodynamic forces exerted on the body and the flexible band wing.

More specifically, a vehicle comprises an aerodynamically shaped body having a longitudinal centerline, means for controlling the direction of motion of the body, and a propulsion system operable to drive the body forwardly. A flexible band wing is supported from the body, and there is means for permitting the flexible band wing to rotate about the centerline of the body responsive to aerodynamic forces exerted on the flexible band wing. The means for permitting the flexible band wing to rotate preferably includes a cylindrically rotating bearing mounted with the cylindrical axis of rotation of the bearing parallel to, and most preferably coincident with, the longitudinal axis of the aerodynamically shaped body. The struts that support the flexible band are mounted to the bearing housing, so that the flexible band wing orientation rotates about the centerline of the body responsive to aerodynamic forces exerted on the flexible band.

With a conventional flexible band wing having a fixed orientation when deployed, as the missile turns the aerodynamic lift vector generated by the flexible band does not necessarily coincide with the plane in which the missile is turning under the influence of the control surfaces. The lift force of the wing will have a component orthogonal to the plane of the turn. The missile therefore tends to turn sluggishly, because the lift forces are acting to change the plane of the turn. To overcome this sluggishness, it is possible to roll the missile about its longitudinal centerline prior to the initiation of the turn, but this rolling requires additional time and the expenditure of fuel, and may be difficult to control.

In the present approach, by contrast, the flexible band is free to rotate about the longitudinal centerline of the missile, so that its lift forces rotate to automatically coincide with the plane of the maneuver. The rotation requires no sensor system and actuator to cause the bearing to turn. Instead, the rotation of the bearing results from the unbalanced aerodynamic forces exerted on the flexible band as the turn progresses. The bearing rotates so as to bring the unbalanced forces back into balance. In this orientation, the lifting forces of the flexible band no longer work to change the plane of the turn. The result is improved maneuverability of the missile, and a disappearance of the sluggishness and control difficulties observed with a fixed flexible band wing. Although weight is added to the structure due to the bearing, that weight increase is relatively small because no sensors and actuators are required.

The present invention therefore provides an improvement to vehicles that utilize a flexible band wing, improving the maneuverability of the vehicle while adding only marginal weight. The improved system is reliable, because it utilizes only passive mechanical components. Other features and advantages of the invention will be apparent from the following more detailed description of the preferred embodiment, taken in conjunction with the accompanying drawings which illustrate,by way of example, the principles of the invention.

DETAILED DESCRIPTION OF THE INVENTION

Figure 1:
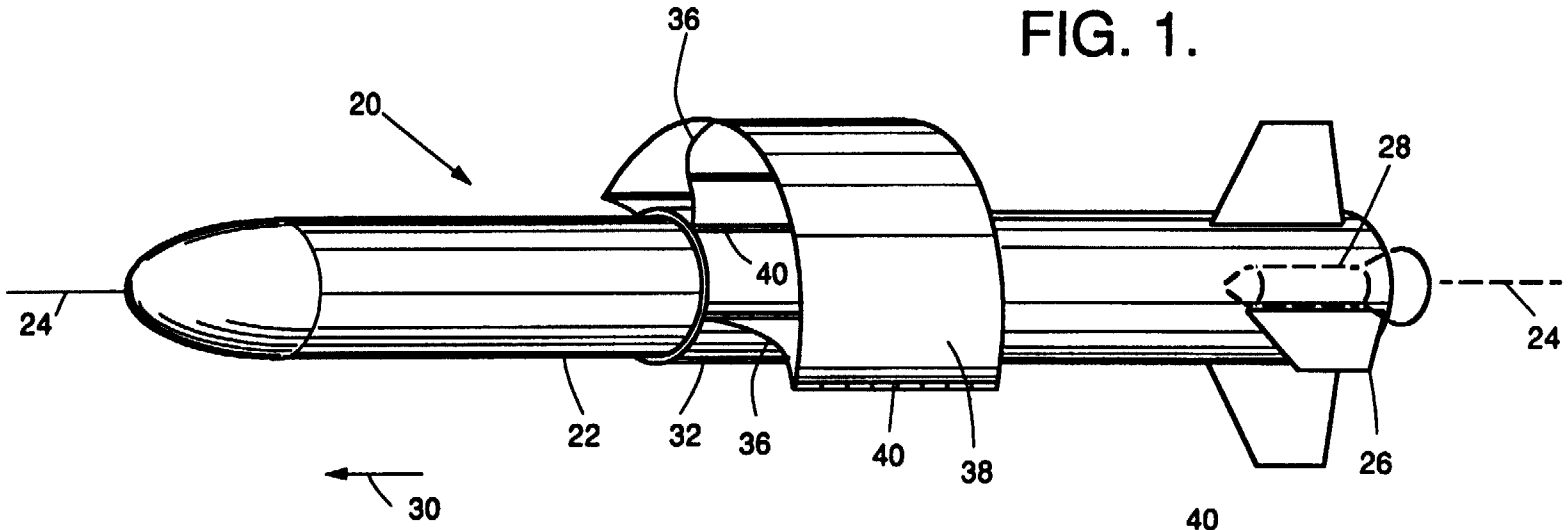
FIG. 1 is a schematic perspective view of a missile with a deployed flexible band wing.

A vehicle utilizing the present invention, in this case a missile 20, is illustrated in FIG. 1. The missile 20 has a body 22 with a longitudinal centerline axis 24. There are movable control fins 26 mounted on the tail of the missile 20, which are used to steer the flight path of the missile 20 under the command of a flight controller (not shown). (Equivalently for the present purposes, the control fins may be mounted on the nose of the missile.) A propulsion unit, here a rocket motor 28, is mounted in the tail of the missile 20. When fired, the rocket motor 28 propels the missile 20 in a forwardly direction, indicated by numeral 80. Equivalently for the present purposes, the missile may move forwardly when released from an aircraft in flight propelled by the force of gravity.

Figure 3:
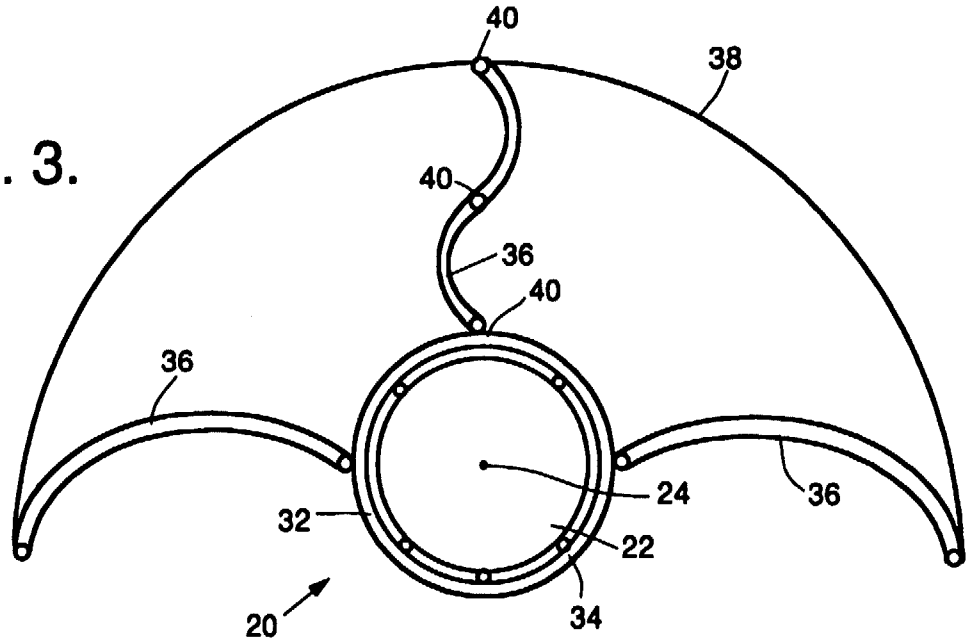
FIG. 3 is a front elevational view like that of FIG. 2, except that the flexible band is in the same deployed position as shown in FIG. 1.

A cylindrical bearing 32 is rotationally mounted to the body 22 of the missile 20. The bearing 32 has a cylindrical axis about which it rotates that is parallel to the centerline axis 24 of the body 22 of the missile 20 and, preferably, is coincident with the centerline axis 24. The bearing 32 is supported on bearing elements 34, which may be seen more clearly in FIG. 3. The bearing elements 34 permit the bearing 32 to rotate about its cylindrical axis. The bearing elements 34 may be any operable type of conventional bearing element, such as balls running in races or roller elements. The bearing elements 34 could also be unconventional, such as air jets that cause the bearing to operate as an air bearing. An air bearing may be particularly feasible when the present invention is utilized on a missile that is launched forwardly from a fast-flying aircraft and never operates at low speeds.

Figure 2:
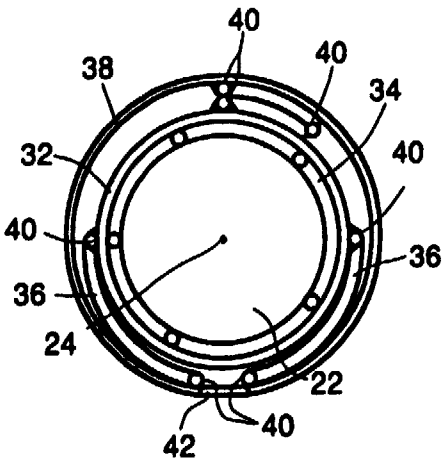
FIG. 2 is a front elevational view of the missile of FIG. 1, showing the flexible band in the stored position.

Attached to the external surface of the bearing 32 are struts 36 that support a flexible band 38. The struts are attached by hinges 40 to the bearing 32 at one end and to the flexible band 38 at the other end. In a stored position, FIG. 2, the hinges 40 are folded so that the struts 36 and the flexible band 38 are wrapped around the circumference of the body 22 of the missile 20. They are held in place by a strap 42 or equivalent retention mechanism. When the missile is launched, FIG. 3, the strap 42 is parted. The spring forces existing in the flexible band 38 due to its being wrapped around the body now act to deploy the flexible band to a less stressed position away from the body 22. The hinges 40 open so that the struts 36 extend away from the body 22. The flexible band 38 is thereby supported in a generally semicircular arc parallel to the curve of the body 22, as seen from the front in FIG. 3 and also shown in FIG. 1.

During flight, the bearing 32 is free to rotate about its cylindrical axis and thence about the centerline axis 24 of the missile body 22. The bearing 32 rotates so as to reduce unbalanced aerodynamic forces on the flexible band 38 in the deployed position. The origin of these unbalanced aerodynamic forces is illustrated in FIG. 4.

Figure 4A:
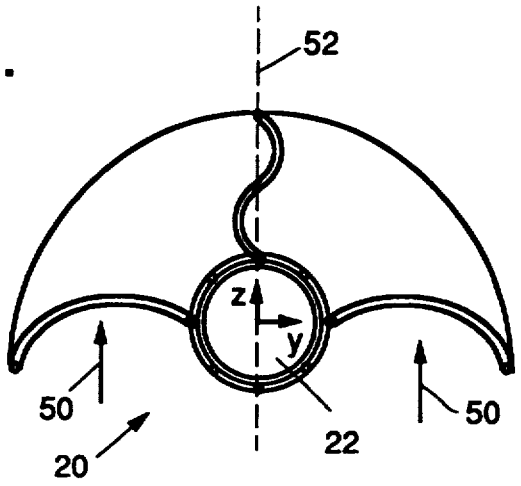
FIG. 4A is a schematic front view of the missile illustrating the aerodynamic forces during straight flight.

FIG. 4A depicts the aerodynamic forces on the flexible band 38 and the bearing forces when the missile 20 is in straight flight and maneuvering in a vertical plane only. There are equal lift and balanced aerodynamic forces on both sides of the flexible band 38, as indicated at numeral 50. There is therefore no driving force for the bearing 32 to rotate about a neutral-balance axis 52.

Figure 4B:
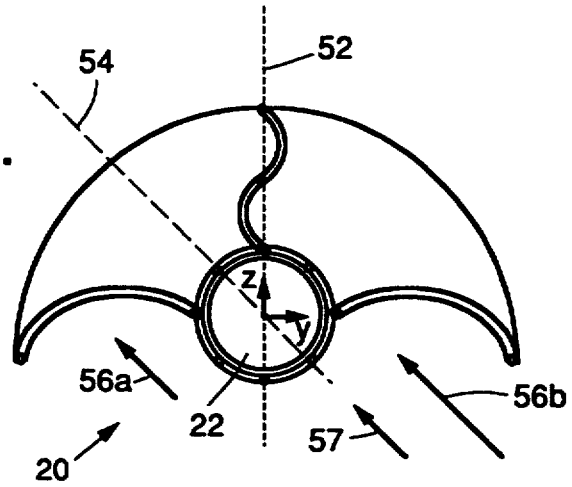
FIG. 4B is a schematic front view of the missile illustrating the aerodynamic forces at the initiation of a turn, before rotation of the flexible band.

When a maneuver or turn about a non-vertical plane 54 is initiated by a movement of the control fins 26, the two sides of the flexible band 38 and support struts 36 are no longer in equal orientations relative to an airflow 57, as shown in FIG. 4B. The result of the different orientations is the generation of a greater lift 56*b* on one side of the flexible band 38 relative to the lift 56*a* on the other side. This produces unbalanced lifting forces 56 on the flexible band 38.

The resultant of the unbalanced forces 56*a* and 56*b* is transmitted as a torque through the struts 36 to the bearing 32. The torque causes the bearing 32 to rotate responsively in a direction so as to reduce the magnitude of the torque. The bearing 32 therefore rotates toward the maneuver plane 54. When that rotational position is reached, FIG. 4C, there remains no unbalanced force on the flexible band, the torque becomes zero, and the bearing rotates no further. The neutral balance axis of the flexible band 38 again coincides with the maneuver axis 54.

Figure 4C:
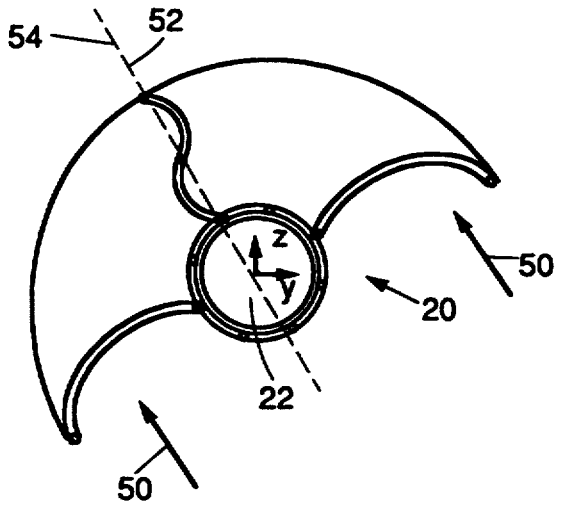
FIG. 4C is a schematic front view of the missile illustrating the aerodynamic forces after rotation of the flexible band about the center line of the missile.

FIGS. 4A, 4B and 4C depict the maneuver as being abrupt, but in practice the maneuver plane gradually shifts as the missile control fins operate and the missile begins to turn. The bearing rotation follows this change in the maneuver plane, so that the aerodynamic forces acting on each side of the flexible wing 38 remain nearly balanced. The lifting force of the flexible band therefore remains entirely in the plane of the maneuver, and the sluggishness of maneuvering is reduced or avoided entirely.

The present approach therefore improves the performance of missiles and other types of aerodynamic vehicles that utilize a flexible band wing. Although a particular embodiment of the invention has been described in detail for purposes of illustration, various modifications may be made without departing from the spirit and scope of the invention. Accordingly, the invention is not to be limited except as by the appended claims.

What is claimed is:

1. A vehicle, comprising:

an aerodynamically shaped body having a curved outer surface and a longitudinal centerline;

means for controlling the direction of motion of the body;

a flexible band wing supported from the body, said flexible band wing forming an arc extending parallel to a portion of the curved outer surface of the body; and means for permitting the flexible band wing to freely rotate about the curved outer surface of the body responsive to aerodynamic forces exerted on the body and the flexible band wing.

2. The vehicle of claim 1, wherein the means for controlling includes a set of fins mounted to the aerodynamically shaped body.

3. The vehicle of claim 1, wherein the vehicle further includes a propulsion system operable to drive the body forwardly.

4. The vehicle of claim 3, wherein the propulsion system includes an engine mounted within the aerodynamically shaped body.

5. The vehicle of claim 1, wherein the means for permitting rotation includes a rotational bearing mounted on the aerodynamically shaped body, and the flexible band wind is mounted to the bearing.

6. The vehicle of claim 5, wherein the bearing is a cylindrical bearing having a cylindrical axis coincident with the longitudinal centerline of the aerodynamically shaped body.

7. The vehicle of claim 1, wherein the flexible band wing forms a generally semicircular arc extending parallel to a portion of the curved outer surface of the body.

8. A vehicle, comprising:

an aerodynamically shaped missile body having a curved outer surface and a longitudinal centerline;

a set of control surfaces joined to the missile body;

a cylindrical rotational bearing mounted on the missile body with its cylindrical axis coincident with the longitudinal centerline of the missile body; and a flexible band wing supported from the rotational bearing, said flexible band wing forming an arc extending parallel to a portion of the curved outer surface of the missile body;

whereby the flexible band wing may freely rotate about the curved outer surface of the missile body responsive to aerodynamic forces exerted on the missile body and the flexible band wing.

9. The vehicle of claim 8, wherein the vehicle further includes a propulsion system operable to drive the missile body forwardly.

10. The vehicle of claim 8, wherein the flexible band wing forms a generally semicircular arc extending parallel to a portion of the curved outer surface of the missile body.

* * * * *